US005921311A

United States Patent [19]

Menendez et al.

[11] Patent Number: 5,921,311

[45] **Date of Patent: *Jul. 13, 1999**

[54] INSTALLATION FOR ELIMINATING IMPURITIES DURING CASTING OF METALS

[75] Inventors: Fernando Sitges Menendez, Salinas-Castrillon; Francisco Alvarez Tamargo, Luanco; Francisco Tamargo Garcia, Salinas-Castrillon; Jose M. Matinez Valdes, Arnao-Castrillon, all of Spain

[73] Assignee: Asturiana De Zinc, S.A., Asturias, Spain

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,009

[22] Filed: Sep. 26, 1996

[51] Int. Cl.[6] ..... B22D 44/00

[52] U.S. Cl. ..... 164/337; 164/335; 266/230

[58] Field of Search ..... 164/337, 335, 164/133, 134; 266/230, 231, 232

[56] References Cited

U.S. PATENT DOCUMENTS 3,111,732 11/1963 Schroer et al. ..... 22/209

FOREIGN PATENT DOCUMENTS

| | | |
|---|---|---|
| 1090234 | 11/1953 | France . |
| 1178059 | 6/1957 | France . |
| 2422821 | 11/1974 | Germany . |
| 466025 | 1/1978 | Spain . |

*Primary Examiner*—Patrick Ryan
*Assistant Examiner*—I.-H. Lin
*Attorney, Agent, or Firm*—Ostrolenk, Faber, Gerb & Soffen, LLP

[57] ABSTRACT

An installation for eliminating impurities during casting of metals, comprising at least one casting ladle (2) which forms an outlet siphon (3) and can tilt around a transverse axis (14). Starting from the siphon (3), the casting ladle (2) is prolonged by a conduit (4) which ends at a scum-retaining pan (5), wherein the conduit forms a single piece with the ladle and the pan. The pan (5) has outlet orifices (7) at the bottom and is externally lined with a ceramic cloth (10) which acts as a filter for retention of impurities.

12 Claims, 4 Drawing Sheets

INSTALLATION FOR ELIMINATING IMPURITIES DURING CASTING OF METALS

BACKGROUND OF THE INVENTION

The invention relates to an installation for eliminating impurities during casting of metals, particularly impurities which float in the form of scum on the surface of the cast metal and more particularly comprise oxides of the metal. The invention is particularly applicable to casting of non-ferrous metals such as zinc.

All metals leaving furnaces in a molten state contain included impurities which generally consist of oxidized particles of the metal in question.

When the metal is poured into an ingot mold and left at rest, the impurities rise to the surface and float thereon in the form of scum. Irrespective of these impurities, quantities of oxides of the metal occur during the operations of casting it, depending on the manner in which the cast metal is handled. The quantity of oxides increases or decreases with the speed of casting. If the casting speed is constant, the proportion of oxides in the form of scum will still be increased or reduced depending on the height from which the metal cascades or falls on to the ingot mold.

After solidifying, the scum remains on the ingots, contaminating their metal. The scum also acquires a spongy texture into which ambient moisture, rain water and the like penetrate, making it very dangerous to re-melt the ingots subsequently.

Due mainly to these disadvantages, it is desirable to obtain ingots free from such scum and consequently free from the resulting disadvantages. It is therefore necessary to eliminate the impurities originating from the melting furnace or formed during handling of the cast metal.

For the reasons stated, these kind of impurities are usually eliminated on the ingot mold once the cast metal has been poured into it. This avoids the risk of further oxidation when the metal is left at rest.

Impurities in the cast metal poured into the mold are removed by means of scoops which move over the surface of the cast metal, starting from one of the edges, in order to pull along and collect the floating scum. Generally, two scoops are used and the scum is collected between them. The scoops can be actuated manually or mechanically. In the first case, the operation is laborious and dangerous, whereas the second case involves investment in machinery, maintenance costs and the like.

To solve there problems, Spanish Patent 466 025 by the present Applicants discloses a machine for separation of scum during casting of metals wherein the machine performs two separation phases or steps, both based on retention of the scum during the travel of the cast metal from the furnace to the mold. The first step or phase, during which the scum is retained, occurs in the casting ladle, where the cast metal arrives from the furnace. To this end, a siphon is formed at the outlet of the ladle and the cast metal flows through it so as to retain the scum floating on the metal. Between the casting ladle and the ingot mold, the cast metal flows along a conduit which discharges on to the mold, agitating the metal and thus resulting in further quantities of oxides, which are retained during a second or separation phase using a scum-retaining pan which is situated on the bottom of the mold and above which the outlet duct from the casting ladle discharges. The pan is formed with outlet orifices which open directly on to the bottom of the mold, thus avoiding further formation of oxides.

The machine described can efficiently retain the impurities which float on the cast metal, but there is a need for independent components, i.e. the casting ladle and retaining pan, and the corresponding actuating mechanisms, which have to be accurately coordinated with one another.

On the one hand, the casting ladle has to be mounted above a mechanism for tilting it between two extreme positions, i.e. a front or filling position at which it receives the molten metal from the melting furnace and at which the outlet of the siphon is situated at a height above that reached by the metal inside the mold, and a pouring position at which the outlet mouth of the siphon descends to a height at which the molten metal can flow out in sufficient volume to fill one or more ingot molds. At the same time, the scum-retaining pan must be mounted in a mechanism for moving it vertically between a bottom position, at which it rests on the bottom of the mold so as to receive the cast metal coming from the casting ladle, and a top position at which it is situated above the edge of the ingot mold wall so that the molds can be moved.

SUMMARY OF THE INVENTION

The invention relates to an installation for elimination of impurities during casting of metals and designed so as to greatly reduce the formation of oxides during the flow of cast metal from the fusion furnace to the ingot mold.

Another object of the invention is to simplify the construction and operation of the installation for separating the impurities, by reducing the number of moving parts thereof and consequently reducing the mechanisms necessary for actuating them.

In order to greatly reduce the production of oxides, the installation according to the invention is designed so that the flow of metal from the melting furnace to the mold is as gentle as possible and compatible with the required production rate, is along sloping surfaces and without falls from excessive heights which are capable of forming oxides.

The installation according to the invention, like the machine described in Spanish Patent 466 025, includes a casting ladle and a scum-retaining pan. According to the present invention, the scum-retaining pan and the casting ladle form a single component, the casting ladle being comprised of an interchangeable ceramic filter cloth and a recess formed at the end of the pouring conduit of the ladle.

The recess formed by the retaining ladle is blocked at the front and has outlet orifices at the bottom.

The ceramic cloth is disposed externally around the pan and covering at least the bottom of the pan, to serve as a filter for collecting the last oxides produced during the final travel of the cast metal from the outlet of the siphon formed in the casting ladle up to the retaining pan.

As a result of the construction described, since the retaining pan is in one piece with the outlet conduit from the casting ladle and owing to the relatively shallow depth of the pan, the cast metal does not fall or pour from the siphon of the casting ladle. Also the slope of the conduit from the siphon outlet is as gentle as possible and compatible with the required production rate.

The design described reduces the formation of oxides when the cast metal flows out of the siphon of the casting ladle. Since the retaining pan is in one piece with the conduit from the casting ladle, there is no need for mechanisms for actuating the pan.

The features and advantages of the invention as summarized in the claims will be understood more easily from the following description with reference to the accompanying drawings, which show a possible embodiment, given by way of non-limitative example.

DESCRIPTION OF A PREFERRED EMBODIMENT

Figure 1:
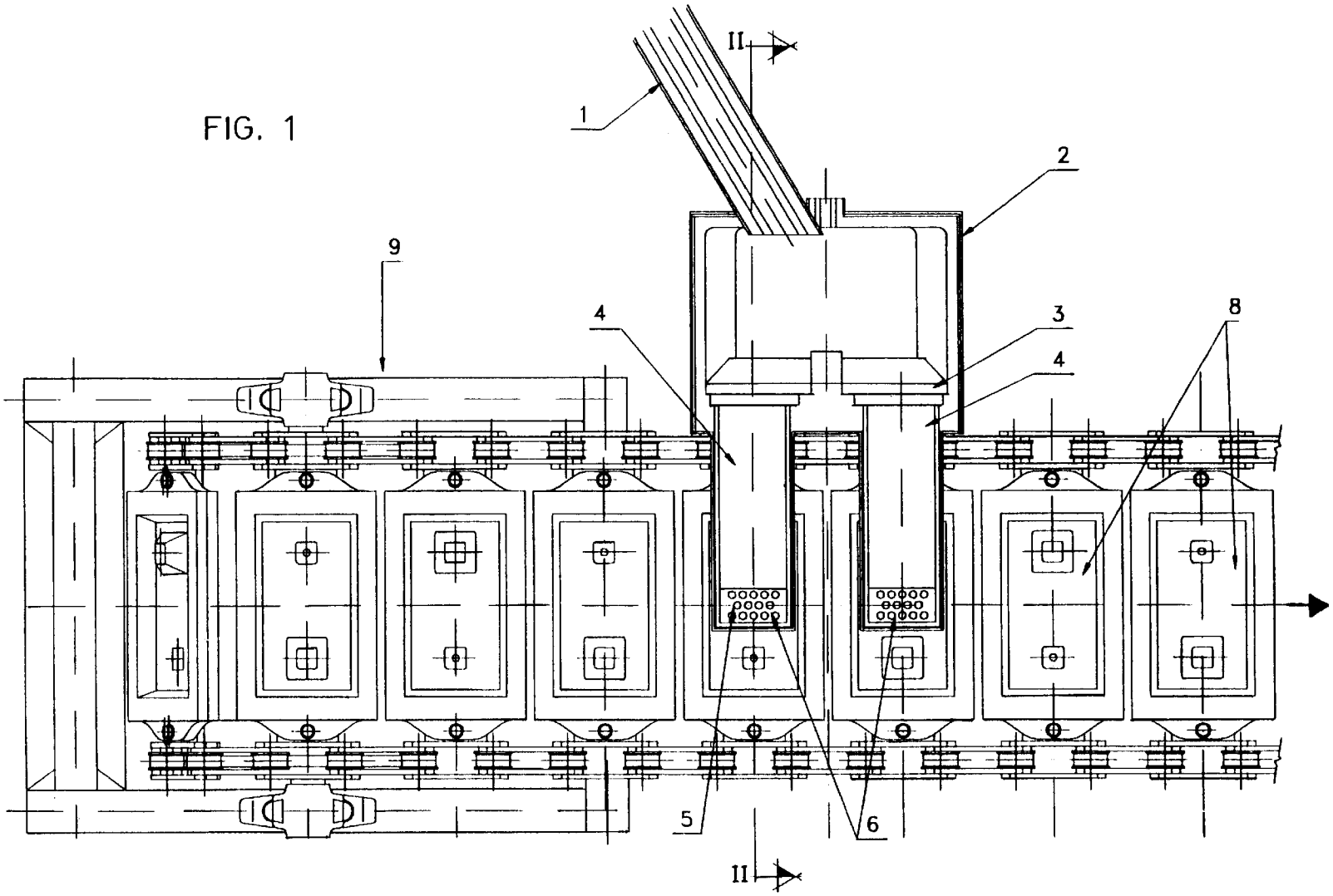
FIG. 1 is a plan view of a machine according to the invention, disposed on a chain of ingot molds in a zinc-producing installation.

The ingot-producing installation comprises a melting furnace (not shown in the drawings) from which an outlet duct 1 (FIGS. 1 to 3) extends and discharges on to a pouring ladle 2. That ladle includes an outlet siphon 3 which in the present case discharges through pouring conduits 4. Each conduit ends in a pan 5 which is transversely blocked at the front by a wall 6 and is formed with outlet orifices 7 at the bottom.

The outlet conduits 4 discharge on to a corresponding number of ingot molds 8 which form part of a chain of molds 9 which are intermittently moved and then remain at rest during the time for pouring the cast metal and filling the mold situated at each moment under the pouring conduits 4. The motion of the chain 9 is controlled so that at each stop, two empty ingot molds 8 are situated under the outlet conduits 4.

Of course, the casting or pouring ladle 2 can have a single outlet conduit or more than two conduits.

The pan or scum-retaining ladle 5 also comprises an outer ceramic cloth 10 which is externally secured to the pan and covers at least the bottom of the pan, serving as a filter for retaining any impurities which might pass through the orifices 7 in the pan.

The ceramic cloth 10 is interchangeable and replaceable. It can be fitted by means of a metal ring 11 disposed around the pan 5 and provided with external spikes 12 at which the ceramic cloth 10 can easily be secured or released.

Figure 2:
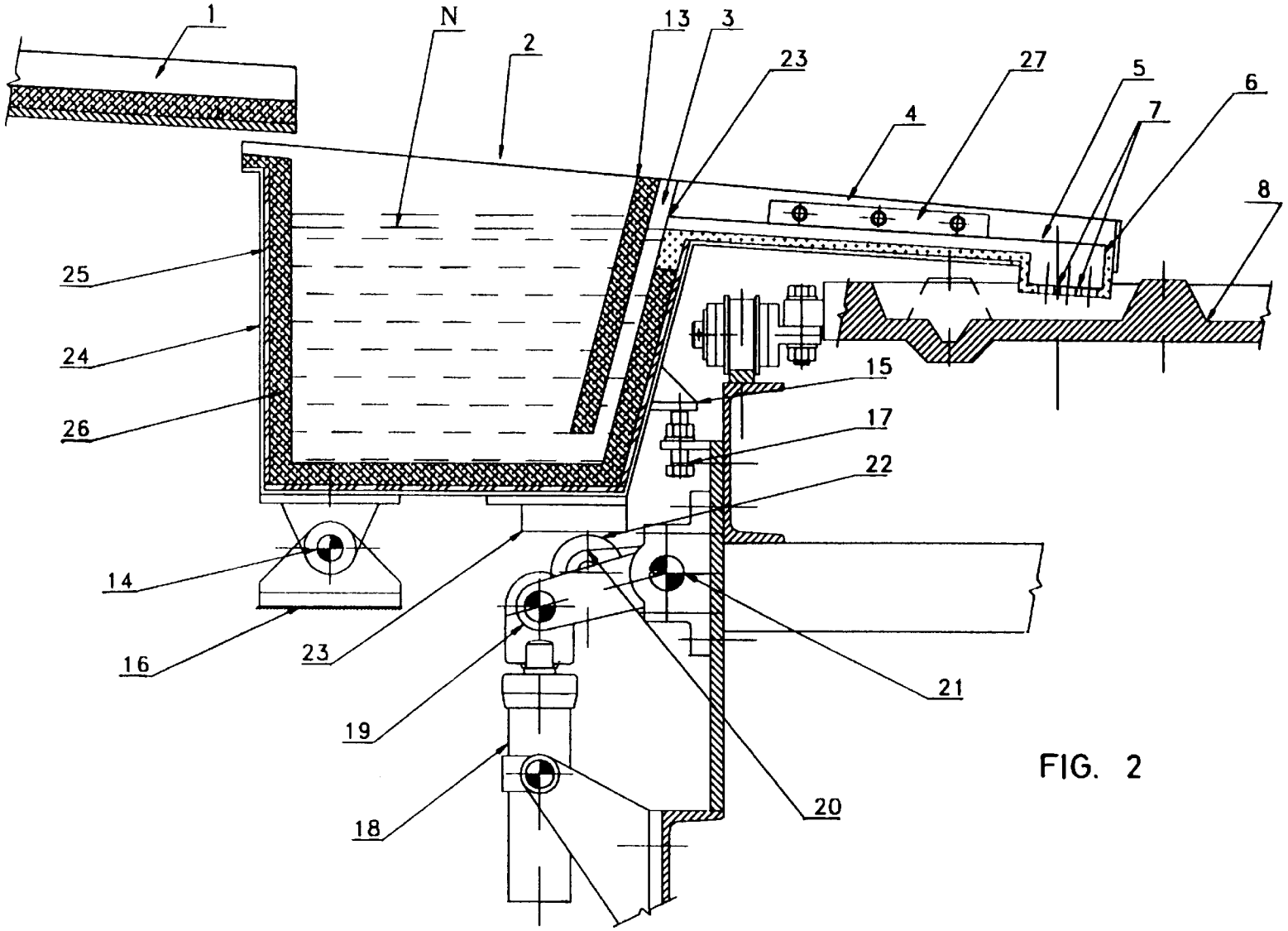
FIG. 2 is a section of the machine according to the invention along line II—II in FIG. 1, showing the casting ladle in the end position for pouring.
Figure 3:
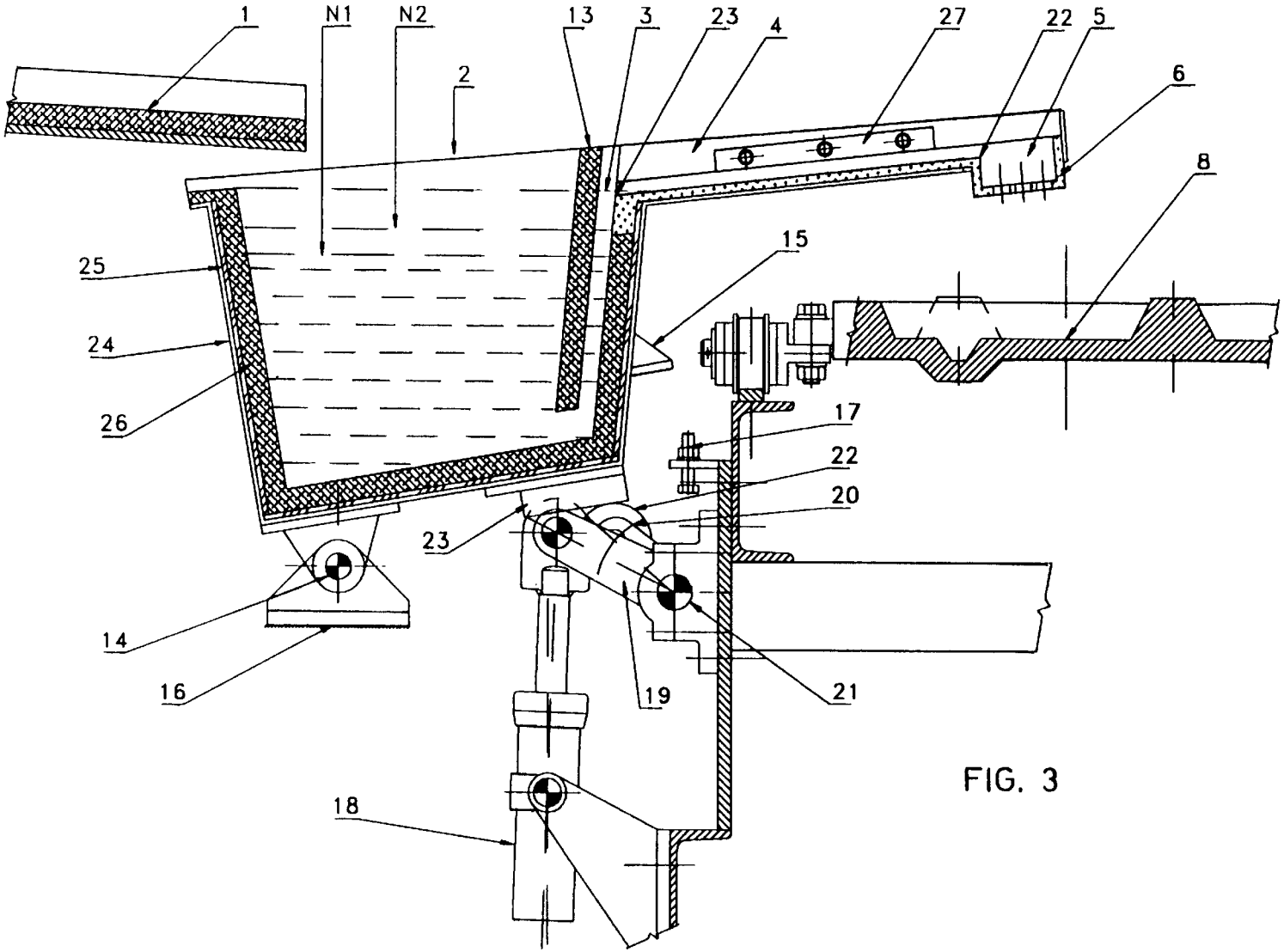
FIG. 3 is a view similar to FIG. A, showing the casting ladle in the end position for filling.

As shown in FIGS. 2 and 3, the retaining pan 5 is in one piece with the casting ladle 2. The casting ladle also has a partition 13 parallel to and near the wall from where the pouring conduit 4 starts and extending between the adjacent walls to near the bottom, thus forming a siphon 3 through which the cast metal flows when the ladle 2 is situated in the pouring position. The impurities are retained in the form of scum which floats on the cast metal in the ladle 2.

The assembly formed by the ladle 2, siphon 3, pouring conduit 4 and scum-retaining pan 5 is mounted on a rear joint 14 and a fixed front support 15. The base 16 on which the joint 14 is mounted and the pivot 17 on which the support 15 rests are adjustable in height so that the slope of the conduit 4, when it is in the pouring position, can be adjusted to the minimum necessary and compatible with the required production rate, so as to reduce the speed at which the cast metal is poured and consequently reduce the formation of oxides.

Since the retaining pan 5 is formed at the end of the pouring conduit 4, there is no fall of cast metal from the conduit to the bottom of the mold or from the actual pan in the case when it is a separate component from the pouring conduit 4. Owing to the relatively shallow depth of the pan 5, there is practically no fall of metal from the conduit 4 and consequently no risk of formation of oxides.

The design described consequently reduces the formation of oxides between the outlet of the siphon 3 and the ingot mold 8.

As also shown in FIGS. 2 and 3, the pouring ladle 2 can oscillate between two end positions, i.e. a pouring position shown in FIG. 2 and a metal-receiving position shown in FIG. 3.

In the pouring position shown in FIG. 2, the metal in the casting ladle above the level N is poured out through the conduit 4 until it reaches the mold 8. When all the metal has been poured, the ladle turns on the axis 14 to the position shown in FIG. 3, through action of a hydraulic cylinder 18 and a combination of levers 19 and 20 mounted on a common shaft 21 and through actuating a roller 22 on which a slide 23 rests and is secured to the bottom of the ladle 2, that position the cast metal remaining in the ladle takes up a level $N_1$ which is sufficiently below the pouring edge 23*a* of the ladle. At the came time as the cylinder 18 is actuated, a further measured quantity of metal is poured from the casting furnace and arrives via a duct 1. The measured amount is just sufficient to fill the mold or molds 8 situated under the corresponding pan 5. When the ladle is in the position in FIG. 3, the chain 9 of molds advances, so that new empty molds appear below the casting pans 5.

During the advance of the chain of molds 9, cast metal arrives in the casting ladle 2 and the level rises to $N_2$ but does not reach the pouring edge 23.

When this stage is reached, the cylinder 18 is reactuated by retracting it, so that the ladle is lowered to the position shown in FIG. 2, resulting in a new casting cycle. The ladle 2 is raised and lowered at the most suitable speed in each case.

Figure 4:
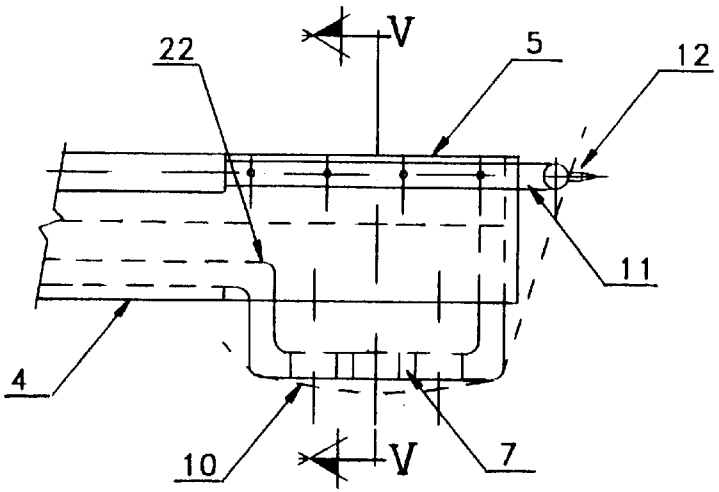
FIG. 4 is a larger-scale side elevation of the scum-retaining pan formed at the end of the pouring conduit.
Figure 5:
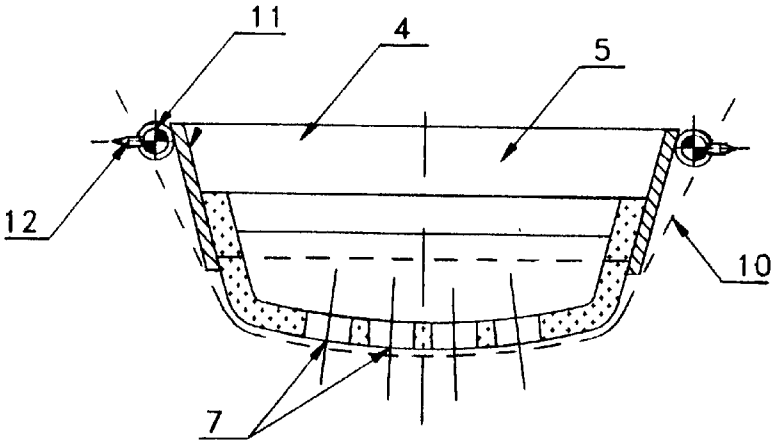
FIG. 5 is a cross-section of the scum-retaining pan along line V—V in FIG. 4.

When the ladle reaches the position in FIG. 2, the metal flows through its own weight through the siphon 3, the conduit 4 and the pan 5 and comes out through the ceramic filter cloth 10, shown in FIGS. 4 and 5.

The cycle described is automatically repeated, two metal ingots being cast in each operation, using the construction shown in the drawings. During this process all impurities originating from the furnace, together with the oxides produced during the metered pouring, the travel through the duct 1 and the fall of metal from the casting ladle 2, float in the ladle 2 and are withdrawn therefrom and deposited in an auxiliary ladle. The reduced quantity of scum which can form along the conduit 4 and comes out through the pan 5 is retained at the bottom of the pan by the ceramic filter cloth 10. The final result in the ingot molds 8 are ingots totally free from adverse products.

In the example shown in the drawings, the casting ladle 2 (FIGS. 2 and 3) comprises a metal casing 24 provided with an inner lining formed by an insulating layer 25 and a refractory inner layer 26 which is cast in one piece on the insulant and by using an inner mold, in order to obtain sealing tightness for sealing off the hot metal so that it cannot reach the insulant 25 or the casing 24. The inner mold itself eliminates the housing for the conduit 4 or for the refractory partition 13 forming the siphon 3. The conduit 4 can be made of silicon carbide and mounted without an insulating lining, but only with a thin layer of refractory mortar and secured e.g. by components 27 to prevent it from moving relative to the metal casing 24.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An installation for eliminating impurities during casting of metals, comprising:

a casting ladle having an inlet to the ladle for metal from a melting furnace;

a siphon communicating into and movable with the ladle, the siphon having an outlet;

the ladle with the siphon being tiltable between a filling position, at which the ladle may receive molten metal while the outlet of the siphon is at a height above the maximum height reached by the molten metal in the ladle, and a pouring position at which the outlet of the siphon is lowered below a level enabling the molten metal to pour out from the ladle through the siphon;

a scum retaining pan for receiving metal from the outlet of the siphon at the ladle;

a conduit communicating between the ladle at the outlet from the siphon and the pan, wherein the conduit forms a single component with the ladle and the pan such that the conduit and the pan tilt together, the conduit being of a length and the conduit being tiltable to a slope sufficient for metal flowing from the ladle to the conduit at a desired production rate, the pan being positionable over an ingot mold for delivering molten metal from the pan into the mold.

2. The installation of claim 1, wherein the scum retaining pan is shaped for receiving the molten metal and includes elements enabling the molten metal to pass out of the pan to the ingot mold.

3. The installation of claim 1, wherein the retaining pan has a base with outlet openings; a filter cloth disposed at the pan and covering the openings at the base for filtering molten metal being delivered to the ingot mold.

4. The installation of claim 3, wherein the filter comprises a ceramic filter cloth.

5. The installation of claim 3, wherein the filter cloth is disposed at the outside of the pan.

6. The installation of claim 5, wherein the filter cloth is interchangeable and replaceable.

7. The installation of claim 5, further comprising a support on the pan to which the filter cloth is secured.

8. The installation of claim 7, wherein the pan has a periphery and the support comprises a ring around the periphery of the pan and spikes on the ring for receiving and securing the cloth thereto.

9. The installation of claim 1, wherein the ladle and the conduit are so tilted in the pouring position that the conduit has the minimum slope necessary for achieving a flow of metal and for achieving the set production rate.

10. The installation of claim 1, wherein the ladle is shaped for forming the siphon in the ladle.

11. The installation of claim 1, wherein the ladle is tiltably supported on a tilt axis arranged for raising and lowering the outlet of the siphon as the ladle is tilted around the axis.

12. The installation of claim 1, wherein the ladle comprises a metal receptacle, the outlet conduit is comprised of the same material as the metal receptacle, a refractory inner lining in the ladle, the conduit having a respective lining and the lining of the conduit forming and defining the scum retaining pan.

* * * * *